US007538729B2

(12) United States Patent
Lin et al.

(10) Patent No.: US 7,538,729 B2
(45) Date of Patent: May 26, 2009

(54) COUPLING ANTENNA

(75) Inventors: Sheng-Chih Lin, Hsin-Tien (TW); Yi-Wei Tseng, Hsin-Tien (TW); Tsung-Wen Chiu, Hsin-Tien (TW); Fu-Ren Hsiao, Hsin-Tien (TW)

(73) Assignee: Advanced Connectek Inc. (TW)

( * ) Notice: Subject to any disclaimer, the term of this patent is extended or adjusted under 35 U.S.C. 154(b) by 0 days.

(21) Appl. No.: 12/028,606

(22) Filed: Feb. 8, 2008

(65) Prior Publication Data

US 2008/0198088 A1 Aug. 21, 2008

(30) Foreign Application Priority Data

Feb. 15, 2007 (TW) ..... 96105851 A

(51) Int. Cl.
*H01Q 1/38* (2006.01)
*H01Q 1/24* (2006.01)

(52) U.S. Cl. ..... 343/700 MS; 343/702; 343/850

(58) Field of Classification Search ..... 343/850, 343/853, 702, 700 MS, 846, 848
See application file for complete search history.

(56) References Cited

U.S. PATENT DOCUMENTS

| | | | | |
|---|---|---|---|---|
| 6,762,723 | B2 * | 7/2004 | Nallo et al. | 343/700 MS |
| 7,423,598 | B2 * | 9/2008 | Bit-Babik et al. | 343/702 |
| 2007/0229366 | A1 * | 10/2007 | Kim et al. | 343/700 MS |
| 2008/0198089 | A1 * | 8/2008 | Hsiao et al. | 343/850 |

* cited by examiner

*Primary Examiner*—HoangAnh T Le
(74) *Attorney, Agent, or Firm*—Hershkovitz & Associates, LLC.; Abraham Hershkovitz

(57) ABSTRACT

A coupling antenna has a ground plane, a main radiating assembly and a secondary radiating assembly. The main radiating assembly is mounted on the ground plane and has a substrate, a feeding-and-coupling assembly and a shorting member. The feeding-and-coupling assembly has a feeding member, a coupling member and an extension member. The second radiating assembly is mounted on the ground plane, is connected to the main radiating assembly and has a first radiating patch and a second radiating patch. With the extension member and the first and second radiating patches, operating bandwidth of the coupling antenna is improved.

5 Claims, 6 Drawing Sheets

COUPLING ANTENNA

BACKGROUND OF THE INVENTION

1. Field of the Invention

The present invention relates to an antenna, and more particularly to a coupling antenna increasing the operating bandwidth thereof.

2. Description of Related Art

Wireless telecommunication technologies have greatly developed to be mature, reliable and marketable so that the market demand for the wireless products greatly increases in the recent years. Antennas, the most important components in wireless products, are designed to increase the operating bandwidth and reduced the size thereof to make the wireless products have high performance and compact structure.

The telecommunication protocols in different areas are distinct and employ different bandwidths. Therefore, wireless product manufacturers design the wireless products to have modulating functions.

With reference to FIG. 1, a conventional multi-band antenna (100) comprises a ground plane (GPN), a pair of regulators (REG), a shorting member (ST) and a first radiating member (110), a second radiating member (150) and a third radiating member (170). The ground plane (GPN) has two ends and a grounding member (G). The regulators (REG) are mounted respectively on the ends of the ground plane (GPN). The shorting member (ST) is formed on the ground plane (GPN) and forms a short circuit between the radiating members (110, 150, 170) and the ground plane (GPN) to reduce the size of the antenna (100). The first radiating member (110) protrudes from the shorting member (ST) and is used to adjust a low operating bandwidth. The second radiating member (150) is connected perpendicularly to the shorting member (ST) and the first radiating member (110) and is used to adjust a low frequency characteristic of a high operating bandwidth. The third radiating member (170) protrudes from the second radiating member (150) and is used to adjust a high frequency characteristic of the high operating bandwidth.

However, the complicated structure of the second and third radiating members (150, 170) greatly increases the thickness of the whole antenna. Furthermore, the antenna (100) is formed by stamping processes. However, the regulators (REG), grounding member (G), shorting circuit member (ST) on the ground plane (GPN) is too tiny to be stamped so that the production rate of the antenna is low. Moreover, the regulators (REG) on the ground plane (GPN) further complicate the structure of the antenna and limit the operating bandwidth of the antenna.

To overcome the shortcomings, the present invention provides a coupling antenna to mitigate or obviate the aforementioned problems.

SUMMARY OF THE INVENTION

The main objective of the invention is to provide a coupling antenna increasing the operating bandwidth thereof.

A coupling antenna in accordance with the present invention has a ground plane, a main radiating assembly and a secondary radiating assembly. The main radiating assembly is mounted on the ground plane and has a substrate, a feeding-and-coupling assembly and a shorting member. The feeding-and-coupling assembly has a feeding member, a coupling member and an extension member. The second radiating assembly is mounted on the ground plane, is connected to the main radiating assembly and has a first radiating patch and a second radiating patch. With the extension member and the first and second radiating patches, operating bandwidth of the coupling antenna is improved.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
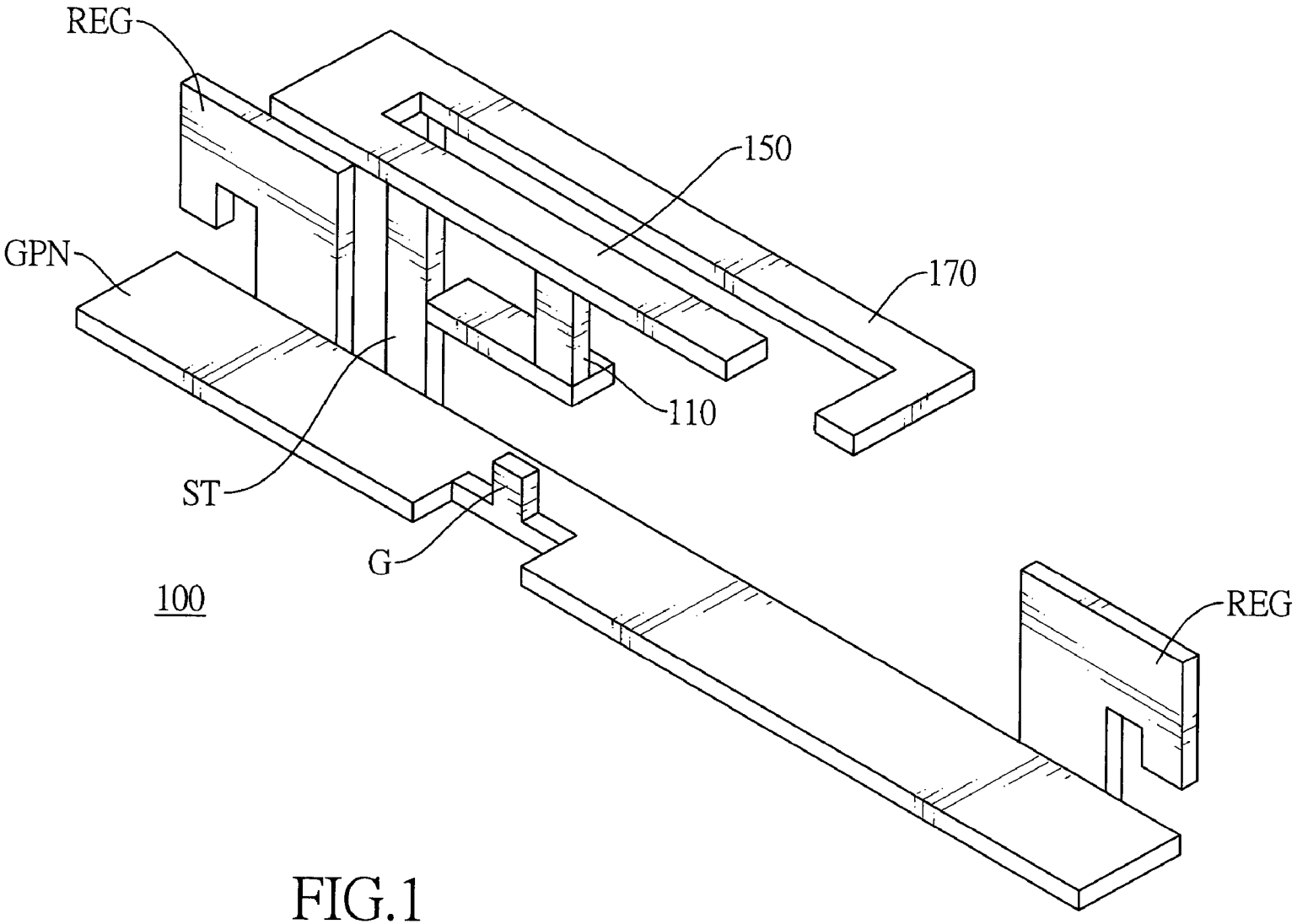
FIG.1 PRIOR ART
FIG. 1 is a perspective view of a conventional multi-band antenna in accordance with the prior art.
Figure 2:
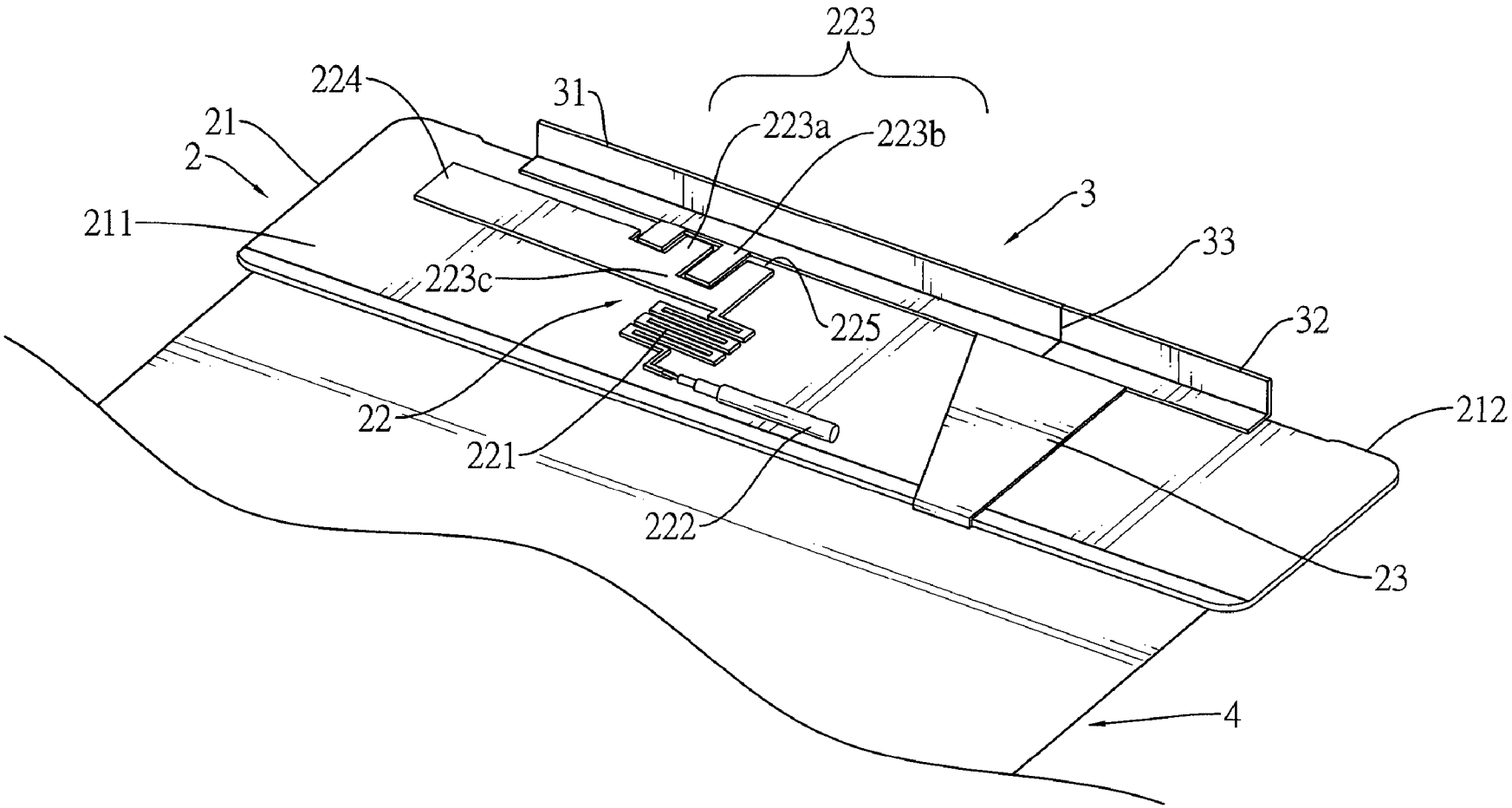
FIG. 2 is a perspective view of a coupling antenna in accordance with the present invention.
Figure 3:
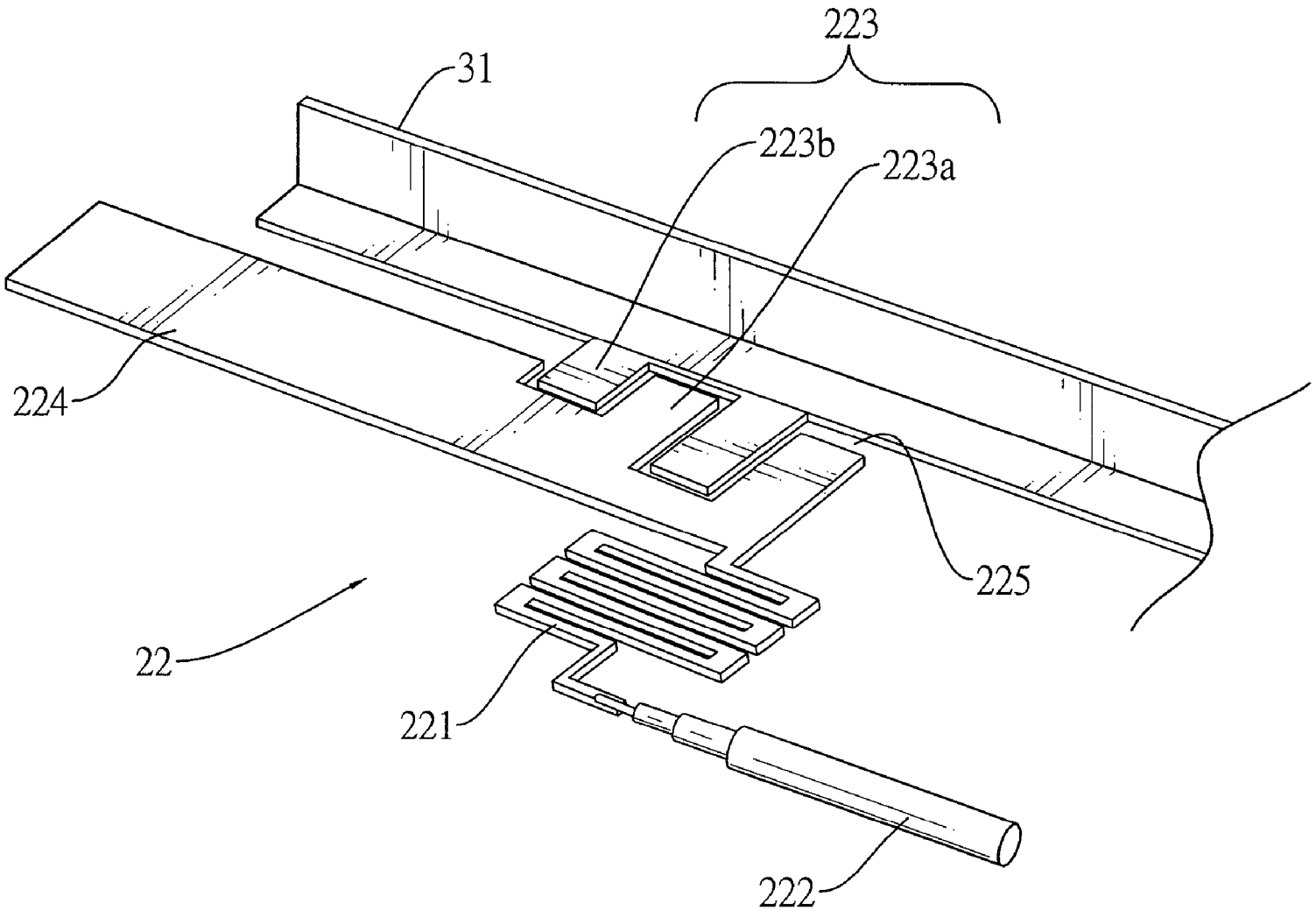
FIG. 3 is a partially enlarged perspective view of the antenna in FIG. 2.

With reference to FIGS. 2 and 3, a coupling antenna in accordance with the present invention comprises a ground plane (4), a main radiating assembly (2) and a secondary radiating assembly (3).

The ground plane (4) is made of metal and has a top surface.

The main radiating assembly (2) is mounted on the ground plane (4) and has a substrate (21), a feeding-and-coupling assembly (22) and a shorting member (23).

The substrate (21) is made of dielectric member, is mounted on the top surface of the ground plane (4) and has a top surface (211) and a side edge. The length and the width of the substrate (21) are about 84 mm and about 9 mm.

The feeding-and-coupling assembly (22) is made of metal, is mounted on the top surface (211) of the substrate (21), connected to a feeding cable (222) and has a feeding member (221), a coupling member (223) and an extension member (224).

The feeding member (221) is zigzag, is mounted on the top surface of the substrate (21), is capable of generating inductive effect and has a connecting end and a feeding end. The zigzag shape of the feeding member (221) increases the inductive effect area therefore to improve the inductive effect. The feeding end is connected to the feeding cable (222). High frequency signals from the feeding cable (222) are transmitted into the feeding member (221). The length of the extended feeding member (21) is about 8 mm.

The coupling member (223) is mounted on the top surface (211) of the substrate (21), is connected to the connecting end of the feeding member (221) and has a body section (223*c*), a first coupling element (223*a*), a second coupling element (223*b*) and a gap (225).

The body section (223*c*) is formed on and protrudes from the connecting end of the feeding member (221).

The first coupling element (223*a*) is formed on and protrudes transversely from the body section (223*c*) and is mounted on the top surface (211) of the substrate (21).

The second coupling element (223*b*) is made of metal, is mounted on the top surface (211) of the substrate (21), corresponds to the first coupling element (223*a*) and is separated from the first coupling element (223*a*).

The gap (225) is zigzag and right-angled, is defined between the first and second coupling elements (223*a*, 223*b*) and the length of the gap (225) is less than 3 mm. The coupling member (223) with the gap (225) is capable of generating capacitive coupling effect to transmit the signals from the feeding member (221).

The extension member (224) is mounted on the top surface (211) of the substrate (21), is connected to the coupling member (223) and is formed on and protrudes longitudinally from the first coupling element (223*a*) of the coupling member (223). The extension member (224) receives the signals from the coupling member (223) and is capable of generating a third high frequency resonant mode. The length of the extension member (224) is about 17 mm and is about one-eighth of a wavelength under a central frequency of 2200 MHz of the third high frequency resonant mode.

The shorting member (23) is made of metal, is mounted on the top surface (211) of the substrate (21), is separated from the feeding-and-coupling assembly (22), is connected to the ground plane (4) and has a grounding end and a connection end. The grounding end is connected to the ground plane (4).

The secondary radiating assembly (3) is mounted on the substrate (21), is connected to the coupling member (223) and the shorting member (23) and has a first radiating patch (31) and a second radiating patch (32). The width of the secondary radiating assembly (3) is about 5 mm.

The first radiating patch (31) is made of metal, is L-shaped, is mounted on the top surface (211) of the substrate (21) and is connected to the second coupling element (223*b*) of the coupling member (223) and the connection end of the shorting member (23). The first radiating patch (31) is capable of generating a low frequency resonant mode and a first high frequency resonant mode. The first radiating patch (31) has a lateral section and an upright section. The lateral section is mounted on the top surface (211) of the substrate (21). The upright section is formed on and protrudes perpendicularly from the lateral section. Furthermore, the length of the first radiating patch (31) is about 42 mm, which is about one-eighth of a wavelength under a central frequency of 890 MHz of the low frequency resonant mode. Also, the length of the first radiating patch (31) is about a quarter of a wavelength under a central frequency of 1750 MHz of the first high frequency resonant mode.

The second radiating patch (32) is made of metal, is L-shaped, is mounted on the top surface (211) of the substrate (21), is connected longitudinally to the first radiating patch (31), is connected to the shorting member (23) and is capable of generating a second high frequency resonant mode. The second radiating patch (32) has a lateral section and an upright section. The lateral section is mounted on the top surface (211) of the substrate (21). The upright section is formed on and protrudes perpendicularly from the lateral section. The length of the second radiating patch (32) is about 19 mm, which is one-eighth of a wavelength under a central frequency of 2000 MHz of the second high frequency resonant mode. The first, second and third resonant modes cooperate to form an extra-wide band operating mode containing multiple system bandwidths.

When the antenna is used, the extension member (224) provides a main current path wherein a current stimulates the third high frequency resonant mode. The first radiating patch (31) of the secondary radiating assembly (3) provides a main current path wherein a current stimulates the low frequency resonant and the first high frequency resonant mode. The second radiating patch (32) of the secondary radiating assembly (3) provides a main current path wherein a current stimulates the second high frequency resonant mode. The feeding-and-coupling assembly (22) feeds signals into the extension member (224), the first radiating patch (31) and the second radiating patch (32) by capacitive coupling means to increase the capacitive coupling effect, reduce the resonant frequency of the antenna and decrease the wavelength of the central frequency of the resonant mode. Furthermore, the feeding member (221) generates inductive effect to cooperate with the coupling effect of the coupling member (223) to adjust the impedance of the antenna. The shape of the feeding member (221) and the area of the gap (225) between the first and second coupling elements (223*a*, 223*b*) are controlled effectively to has a smooth impedance variation. Accordingly, the impedance matching and the operating bandwidth of the coupling antenna are improved. The structure of the coupling antenna is simplified without complicated fabricating processes. The production rate of the coupling antenna increases.

Figure 4:
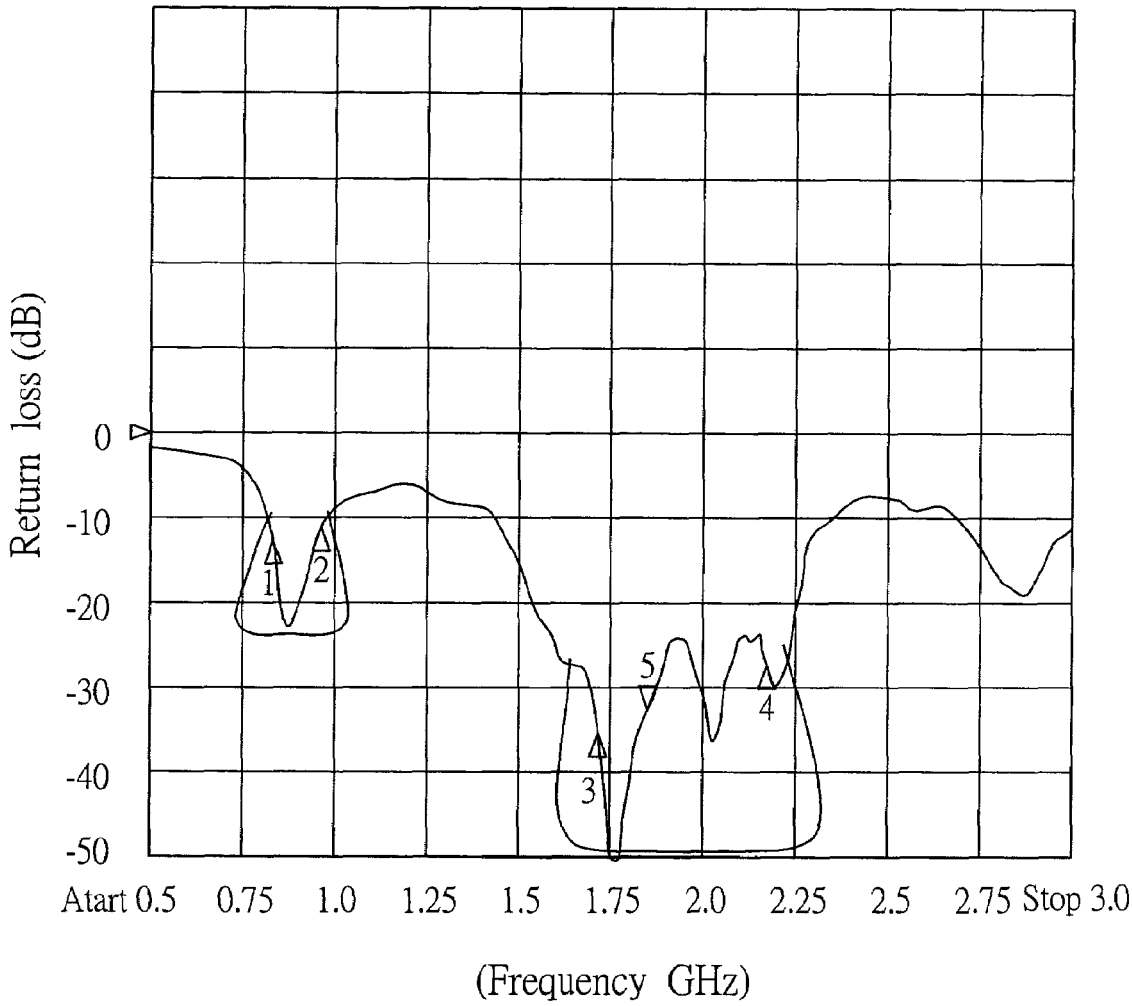
FIG. 4 is a diagram of frequency vs. return loss of the antenna in FIG. 2.

With further reference to FIG. 4 showing a diagram of return loss vs. frequency of the antenna. When the first radiating patch (31) of the coupling antenna generates the low frequency resonant mode, a low bandwidth thereof contains the bandwidths of Advanced Mobile Phone System (AMPS) (824-894 MHz) and Global System For Mobile Communications (GSM) (880-960 MHz). The extra-wide band operating mode generated by the first radiating patch (31), the second radiating patch (32) and the extension member (224) has a bandwidth containing Global Positioning System (GPS) (1575 MHz), Digital Cellular System (DCS) (1710~1880 MHz), Personal Communications System (PCS) (1850~1990 MHz) and Universal Mobile Telecommunications System (UMTS) (1920~2170 MHz).

Figure 5:
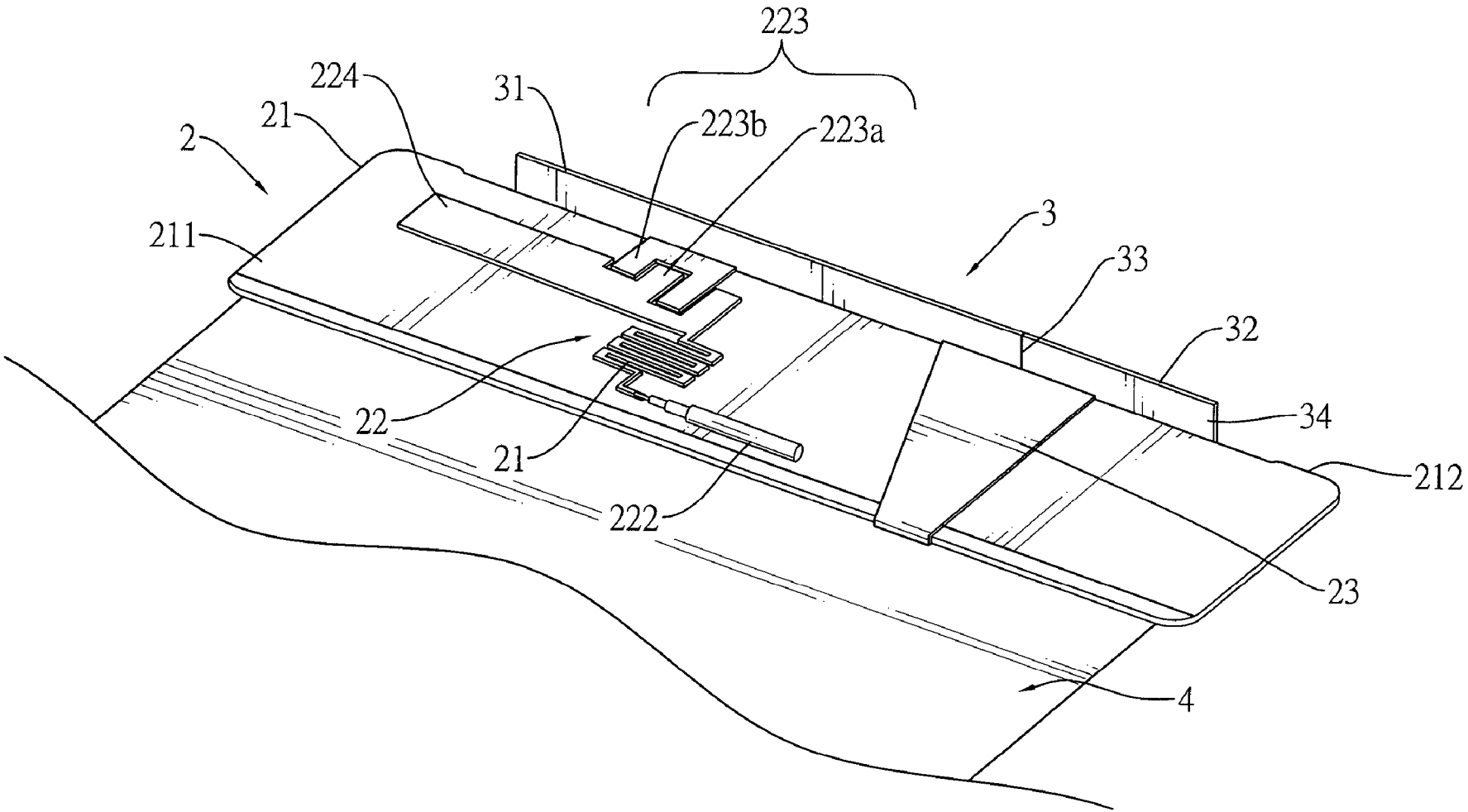
FIG. 5 is a perspective view of a second embodiment of a coupling antenna in accordance with the present invention.

With further reference to FIG. 5, a second embodiment of the coupling antenna in accordance with the present invention is similar to the first embodiment and has the first radiating patch (31) and the second radiating patch (32) being planar and mounted perpendicularly on the side edge of the substrate (21). Each of the first and second radiating patches (31, 32) has an inside surface mounted on the side edge of the substrate (21).

Figure 6:
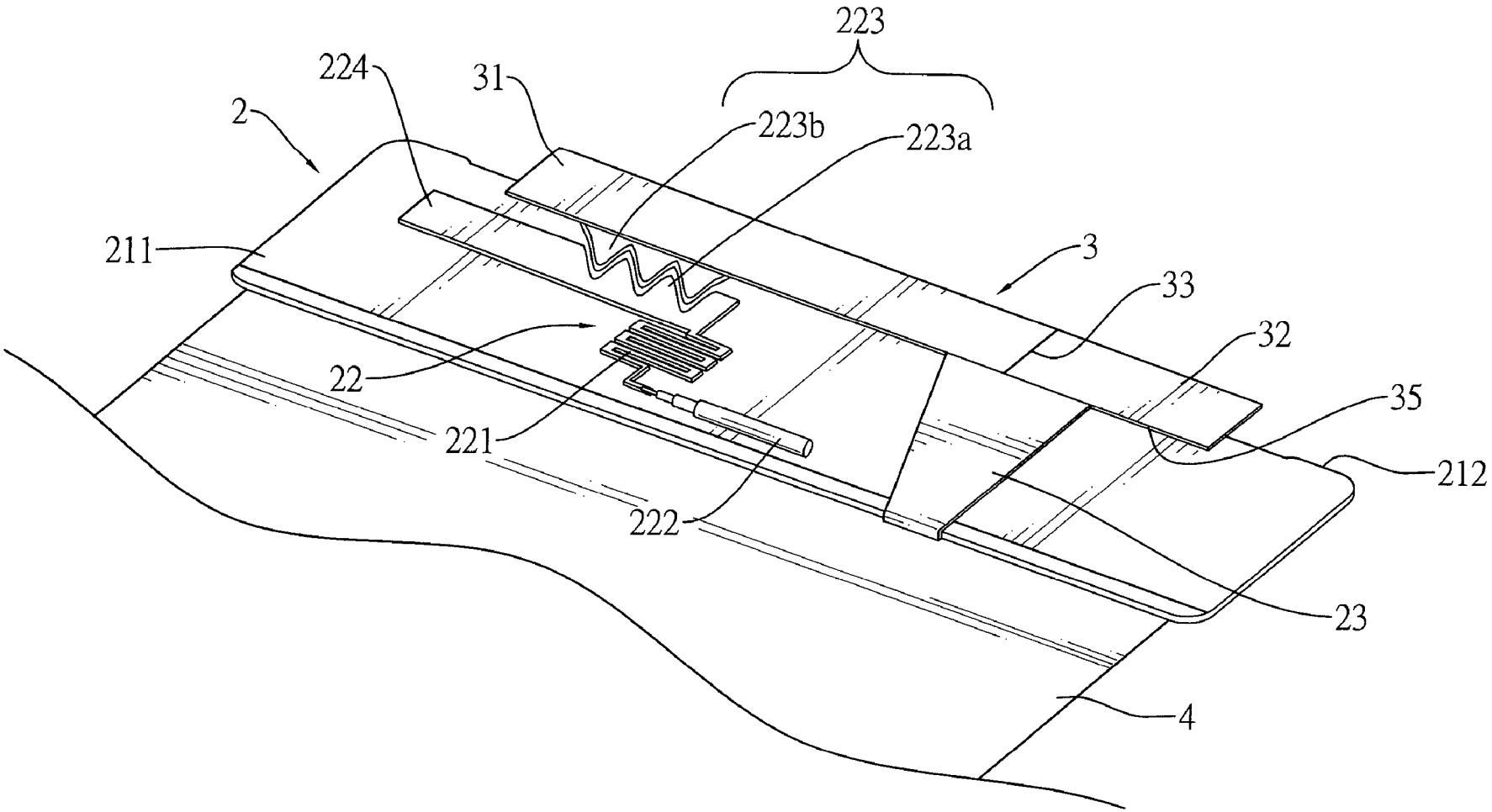
FIG. 6 is a perspective view of a third embodiment of a coupling antenna in accordance with the present invention.

With further reference to FIG. 6, a third embodiment of a coupling antenna in accordance with the present invention is similar to the first embodiment and has the first radiating patch (31) and the second radiating patch (32) being planar and lie flatly on the top surface of the substrate (21). Each of the first and second radiating patches (31, 32) has a side edge (35) connected to the shorting member (23). The gap (225) is wavelike.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A coupling antenna comprising:

a ground plane having a top surface;

a main radiating assembly mounted on the ground plane and having a substrate mounted on the top surface of the ground plane and having a top surface and a side edge;

a feeding-and-coupling assembly mounted on the surface of the substrate and having a feeding member mounted on the substrate and having a connecting end and a feeding end;

a coupling member mounted on the substrate, connected to the connecting end of the feeding member and having a body section formed on and protruding from the connecting end of the feeding member;

a first coupling element formed on and protruding from the body section;

a second coupling element mounted on the substrate, corresponding to and separated from the first coupling element; and a gap defined between the first and second coupling elements; and an extension member mounted on the substrate and connected to first coupling element of the coupling member; and a shorting member mounted on the substrate and connected to the ground plane; and a secondary radiating assembly mounted on the substrate, connected to the coupling member of the main radiating assembly and having a first radiating patch mounted on the substrate and connected to the second coupling element of the coupling member and the shorting member; and a second radiating patch mounted on the substrate and connected to the first radiating patch and the shorting member.

2. The coupling antenna as claimed in claim 1, wherein the feeding member is zigzag.

3. The coupling antenna as claimed in claim 2, wherein the gap between the first and second coupling elements is zigzag.

4. The coupling antenna as claimed in claim 2, wherein the gap between the first and second coupling elements is wave-like.

5. The coupling antenna as claimed in claim 3, wherein:

the first radiating patch is capable of generating a low frequency resonant mode and a first high frequency resonant mode;

the second radiating patch is capable of generating a second high frequency mode; and the extension member is capable of generating a third high frequency resonant mode.

* * * * *